US007188920B2

(12) United States Patent
Shimizu

(10) Patent No.: US 7,188,920 B2
(45) Date of Patent: Mar. 13, 2007

(54) IMAGE RECORDING APPARATUS AND IMAGE RECORDING METHOD

(75) Inventor: Masanobu Shimizu, Hachioji (JP)

(73) Assignee: Olympus Corporation, Tokyo (JP)

( * ) Notice: Subject to any disclaimer, the term of this patent is extended or adjusted under 35 U.S.C. 154(b) by 292 days.

(21) Appl. No.: 10/897,343

(22) Filed: Jul. 21, 2004

(65) Prior Publication Data

US 2005/0018002 A1 Jan. 27, 2005

(30) Foreign Application Priority Data

Jul. 24, 2003 (JP) ..... 2003-201268

(51) Int. Cl.
*B41J 29/38* (2006.01)

(52) U.S. Cl. ..... 347/14; 347/9

(58) Field of Classification Search ..... 347/9, 347/14

See application file for complete search history.

(56) References Cited

U.S. PATENT DOCUMENTS 5,485,179 A * 1/1996 Otsuka et al. ..... 347/14
5,515,087 A * 5/1996 Lim et al. ..... 347/19
6,076,916 A * 6/2000 Kaneko ..... 347/37
6,729,710 B2 * 5/2004 Chikuma et al. ..... 347/14
6,766,121 B2 * 7/2004 Nonaka et al. ..... 399/24
2002/0196300 A1 * 12/2002 Takahashi et al. ..... 347/14
2003/0063152 A1 * 4/2003 Edamura et al. ..... 347/36
2004/0246509 A1 * 12/2004 Hongo et al. ..... 358/1.6

FOREIGN PATENT DOCUMENTS

JP 5-64890 A 3/1993

* cited by examiner

*Primary Examiner*—Stephen Meier
*Assistant Examiner*—Rene Garcia, Jr.
(74) *Attorney, Agent, or Firm*—Frishauf, Holtz, Goodman & Chick, P.C.

(57) ABSTRACT

An image recording apparatus includes a carriage which holds a recording head, and a scanning unit which moves the carriage in relation to a recording medium. The recording head ejects ink while the carriage moves in relation to the medium so as to record an image on the medium. A measuring unit measures a moving distance of the carriage in relation to the medium, and a counting unit counts the number of ink drops ejected from the head. A control unit calculates an image recording duty based on the measured relative moving distance of the carriage and the number of ink-drops ejected during the relative movement of the carriage, when the carriage moves in relation to the medium for a predetermined distance, and the control unit controls ink ejection energy applied to the head in accordance with a value of the calculated duty.

13 Claims, 8 Drawing Sheets

| Temperature of recording head before a start of image recording (T) | Revised driving voltage at a start of image recording (V) |
|---|---|
| T < 10℃ | V = -0.6T + 30 |
| 10℃ ≦ T < 15℃ | V = -0.6T + 30 |
| 15℃ ≦ T < 20℃ | V = -0.4T + 26 |
| T ≧ 20℃ | V = -0.2T + 21 |

| Image recording duty (PD) | Temperature of recording head (TE) | | | | | |
|---|---|---|---|---|---|---|
| | TE < 25℃ | | 25℃ ≦ TE < 30℃ | | 30℃ ≦ TE | |
| | Slope(ε) | Intercept(η) | Slope(ε) | Intercept(η) | Slope(ε) | Intercept(η) |
| 0 ≦ PD < 5 | -0.3 | 10.1 | -0.1 | 4.2 | 0.1 | -2.8 |
| 5 ≦ PD < 10 | -0.3 | 9.0 | -0.1 | 3.7 | 0.1 | -2.6 |
| 10 ≦ PD < 15 | -0.3 | 7.7 | -0.1 | 3.0 | 0.1 | -2.6 |
| 15 ≦ PD < 20 | -0.2 | 6.6 | -0.1 | 2.5 | 0.1 | -2.4 |
| | 0.2 | 5.4 | | | 0.1 | -2.4 |
| 75 ≦ PD < 80 | | | 0.1 | -1.5 | | |
| 80 ≦ PD < 85 | 0.0 | 0.0 | 0.1 | -1.5 | 0.2 | 4.0 |
| 85 ≦ PD < 90 | 0.0 | 0.2 | 0.1 | -1.3 | 0.1 | -3.2 |
| 90 ≦ PD < 95 | 0.0 | -0.1 | 0.1 | -1.2 | 0.1 | -2.6 |
| 95 ≦ PD < 101 | 0.0 | -0.4 | 0.1 | -1.1 | 0.1 | -1.9 |

FIG. 6

| Timing of sampling | Value of PD | Value of revise for head driving voltage |
|---|---|---|
| S1 | 0.3 | 0.00V |
| S2 | 0.4 | 0.00V |
| S3 | 0.5 | -0.08V |
| S4 | 0.6 | 0.00V |
| S5 | 0.7 | -0.08V |
| S6 | 0 | +0.08V |
| S7 | 0 | 0.00V |
| S8 | 0 | -0.08V |
| S9 | 0 | 0.00V |
| S10 | 0 | 0.00V |

IMAGE RECORDING APPARATUS AND IMAGE RECORDING METHOD

CROSS-REFERENCE TO RELATED APPLICATIONS

This application is based upon and claims the benifit of the priority from the prior Japanese Patent Application No. 2003-201268, filed Jul. 24, 2003, the entire contents of which are incorporated herein by reference.

BACKGROUND OF THE INVENTION

1. Field of the Invention

The present invention relates to an image recording apparatus which records an image on a recording medium and a method by which the image is recorded on the recording medium.

2. Description of the Related Art

An image recording apparatuse such as an ink jet printer attaches ink on a recording medium such as a paper to record an image thereon. The image recording apparatus includes a recording head which ejects ink to the recording medium, a carriage which holds the recording head, a recording medium transfer mechanism which transfers the recording medium, and carriage driving mechanism which moves the recording head along an axial line (a main scanning direction MA) crossing an axial line (a sub-scanning direction SA) along a transfer direction of the recording medium by the recording medium transfer mechanism at right angles.

Such conventional image recording apparatus as described above drives the carriage in the main scanning direction MA, and makes the recording head moved together with the carriage eject ink toward the recording medium. With this operation, the conventional image recording apparatus applies the ink drops from the recording head to the recording medium at a substantially equal pitch in the main scanning direction MA and records a part of a desired image for a width of the recording head (that is, a size of the recording head in the sub-scanning direction SA) on the recording medium. The image recording apparatus repeats the above-described operation to the recording medium intermittently transferred in the sub-scanning direction SA and records a whole of the desired image on the recording medium.

Generally in the image recording apparatus, the temperature of the recording head chages while the recording head records the image, due to heat generation of members (piezoelectric element, electrode, driving IC, etc.) constituting the recording head. For example, a rise in the temperature of the recording head during the image recording lowers the viscosity of ink in the recording head gradually. Lowering of the viscosity of ink in the recording head increases an amount of one ink drop ejected from the recording head at one time. Therefore, a diameter of an ink dot attached on the recording medium increases. The recording head ejects ink while it moves in the main scanning direction, and records the image on the recording medium. Since the temperature of the recording head changes while the recording head moves as described above, in the image recorded on the recording medium, an optical density of a part of the image at a start of image recording and that at an end of the image recording are different from each other in one scanning operation, as shown in FIG. 12. Especially, as shown in FIG. 12, when the image recording is performed bidirectionally along the main scanning axial line, a density difference between upper and lower scanning bands becomes remarkable, and a quality of the image recorded on the recording medium is degraded remarkably.

For example, even if, while the image recording apparatus is scaned a plurality of times and records the image on the recording medium, an equal voltage is applied to the recording head to record the image by each scanning, the optical density (OD) of the image recorded by one scanning operation changes, as shown in FIG. 13. FIG. 13 is a graph showing the changes in the optical density of the image in a recording order (that is, a scanning order) in a case where the image is recorded on the recording medium by a plurality of scanning operations of the recording head at a half tone of 60%. As shown in FIG. 13, there is a difference in the optical density between the part of the image at the start of the image recording and that at the end of the image recording in one scanning operation. Concretely, the optical density (OD) of the image increases gradually from the start of the image recording to the end of the image recording. As described above, in the conventional image recording apparatus, the optical density of the image recorded on the recording medium changes in the moving direction of the carriage, and the quality of the recorded image is degraded.

And, since the temperature of the recording head changes rapidly, it is difficult to detect the change in the temperature correctly in real time by a temperature detection element such as a thermistor disposed in the recording head.

In recent years, an image recording apparatus which intends to stabilize the temperature of the recording head has been proposed. Such conventional image recording apparatus as described above is described, for example in Japanese Patent Application KOKAI Publication No. 5-64890, especially in FIG. 5.

In the image recording apparatus of the Publication, a heater is connected to the recording head. And, the change in the temperature of the recording head during the image recording is predicted, and the temperature of the recording head during the image recording is stabilized by the heater.

In another conventional image recording apparatus, while the recording head scans once, a driving voltage applied to the recording head is uniformly lowered to prevent the optical density in the image recorded from the start of the image recording to the end of the image recording in one scanning operation of the recording head from becoming uneven.

In further conventional image recording apparatus, instead of uniformly lowering the driving voltage, image data to be used to record an image is obtained before recording the image. And, while the recording head scans once, the driving voltage applied to the recording head is lowered in accordance with a gradation value of each position of the image data to prevent the optical density in the image recorded from the start of the image recording to the end of the image recording in one scanning operation of the recording head from becoming uneven.

BRIEF SUMMARY OF THE INVENTION

According to an aspect of the present invention, an image recording apparatus includes: a recording head which ejects ink in accordance with energy for ink ejection applied thereto; a carriage which holds the recording head; and a scanning unit which moves the carriage in relation to a recording medium. The recording head ejects ink while the carriage moves in relation to the recording medium, and records an image on the recording medium. The apparatus also includes: a moving distance measuring unit which measures a relative moving distance of the carriage in relation to the recording medium; an ink drop counting unit which counts the number of ink drops ejected from the recording head; and a control unit which calculates an image recording duty based on the relative moving distance of the carriage measured by the moving distance measuring unit and the number of ink drops ejected from the recording head while the carriage moves the measured relative moving distance, when the carriage moves in relation to the recording medium for a predetermined distance, and which controls the ink ejection energy applied to the recording head in accordance with a value of the calculated image recording duty.

According to another aspect of the present invention, an image recording method is provided in which a carriage holding a recording head is relatively moved in relation to a recording medium, and ink ejection energy is applied to the recording head during the relative movement of the carriage so that ink is ejected from the recording head, thereby recording an image on the recording medium. The method includes: measuring a relative moving distance of the carriage in relation to the recording medium; counting the number of ink drops ejected from the recording head; and calculating an image recording duty based on the measured relative moving distance of the carriage and the number of ink drops ejected from the recording head while the carriage moves the measured relative moving distance, when the carriage moves in relation to the recording medium for a predetermined distance, and controlling the ink ejection energy applied to the recording head in accordance with a value of the calculated image recording duty.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 6 is a diagram showing a table of temperature-revised image recording duty;

DETAILED DESCRIPTION OF THE INVENTION

An embodiment and a plurality of modifications of the present invention will be described hereinafter with reference to FIGS. 1 to 11.

Figure 1:
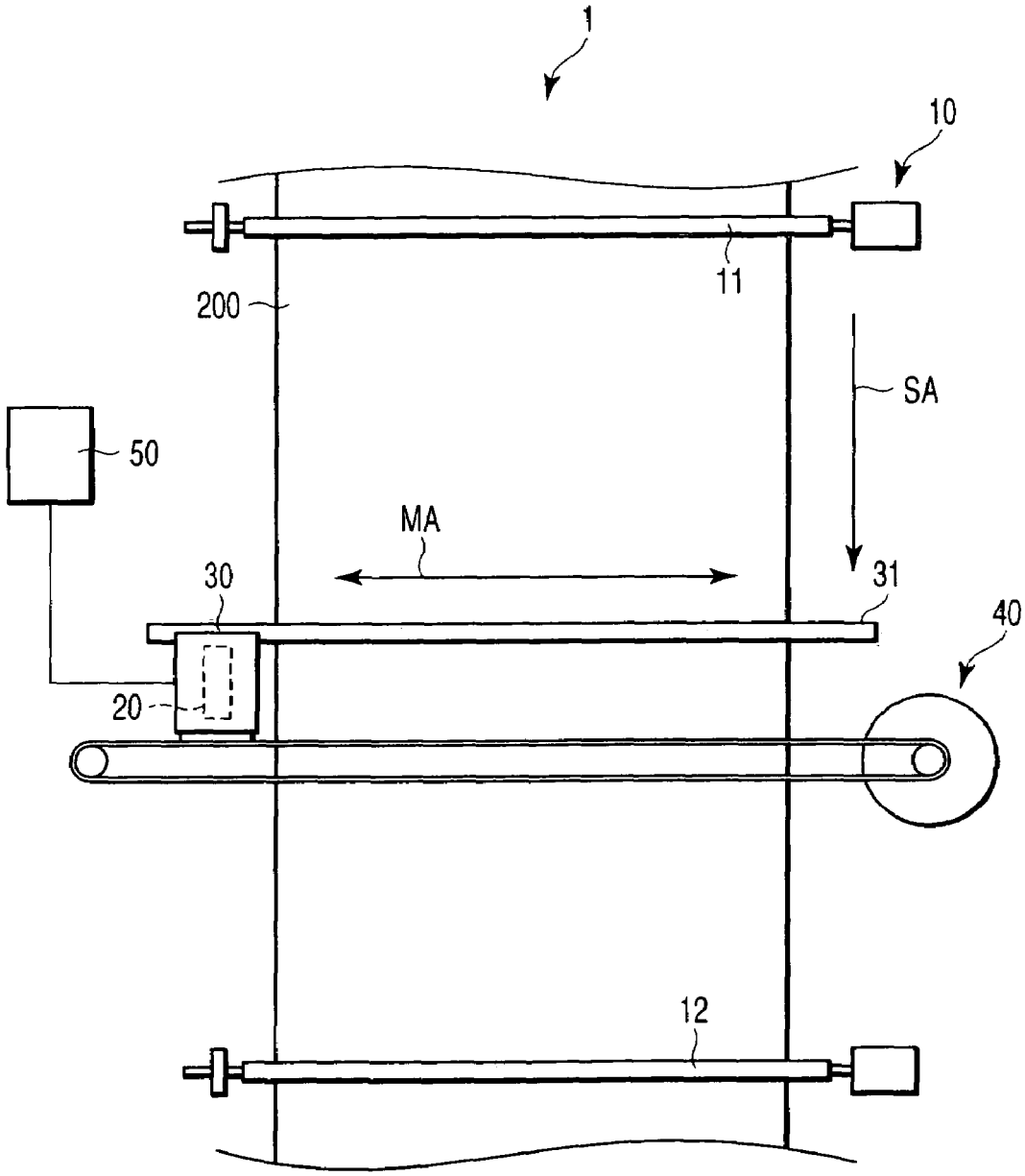
FIG. 1 is a front view schematically showing an image recording apparatus according to one embodiment of the present invention.
Figure 2:
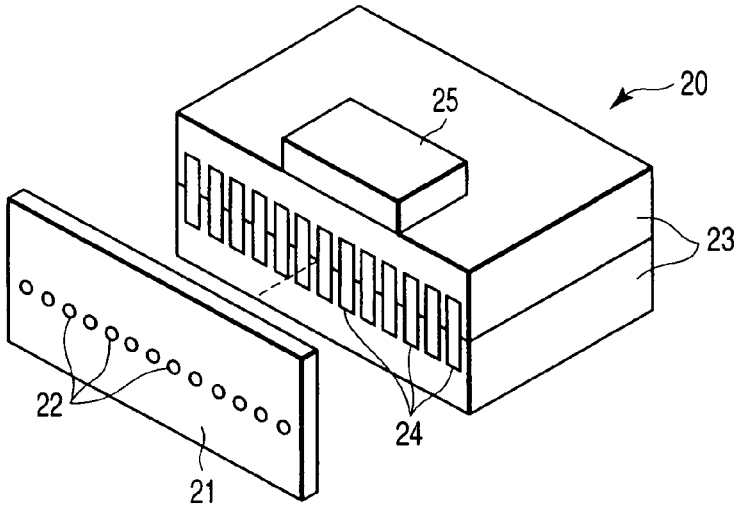
FIG. 2 is a schematical partially exploded perspective view of a recording head of the image recording apparatus in FIG. 1.

At first, a constitution of an image recording apparatus according to the embodiment of the present invention will be described with reference to FIGS. 1 and 2. FIG. 1 is a front view schematically showing the image recording apparatus according to the embodiment. FIG. 2 is a schematical exploded perspective view of a recording head in FIG. 1.

[Constitution]

The image recording apparatus 1 of the embodiment includes a recording medium transfer mechanism 10, a recording head 20, a carriage 30, a linear encoder 31, a carriage driving mechanism 40, and a controller 50.

The recording medium transfer mechanism 10 includes a pair of transfer rollers 11, 12. The recording medium transfer mechanism 10 makes the transfer rollers 11, 12 cooperate with each other, and transfers a recording medium 200 in a predetermined direction. In FIG. 1, the recording medium 200 is transferred downwards in FIG. 1.

The recording head 20 is an ink ejecting unit which is connected to an ink supply source (not shown) and ejects ink toward the recording medium 200. As shown in FIG. 2, the recording head 20 includes a nozzle plate 21, and a pair of piezoelectric elements 23. In the nozzle plate 21, a plurality of ink ejection ports (nozzles) 22 are arranged at predetermined intervals in a predetermined direction. The pair of piezoelectric elements 23 are laminated on each other, and a plurality of channels 24 each of which constitutes a part of an ink passage are formed in the mutually bonded surfaces of the elements 23 at the predetermined intervals in the predetermined direction. The nozzle plate 21 is fixed to the pair of piezoelectric elements 23 in such a manner that each ejection port 22 of the nozzle plate 21 is disposed on each channel 24. The recording head 20 is connected to the controller 50. When a driving voltage from the controller 50 is applied to the pair of piezoelectric elements 23, the pair of piezoelectric elements 23 deform the respective channels 24, and the ink in each channel 24 is ejected from each ejection port 22 of the nozzle plate 21. As the driving voltage applied to the pair of piezoelectric elements 23 increases, an amount of ink ejected from each ejection port 22 increases. Therefore, as the driving voltage applied to the pair of piezoelectric elements 23 increases, a density of the image recorded on the recording medium 200 by ink drops ejected from the ejection ports 22 increases. A head thermistor 25 is attached to the recording head 20. The thermistor 25 is a temperature detection unit which detects the temperature of the recording head 20. The head thermistor 25 is connected to the controller 50 and sends a detection result to the controller 50.

The carriage 30 is a holding unit which holds the recording head 20 and which is supported by the carriage driving mechanism 40 to be movable in a predetermined direction. The linear encoder 31 is a moving distance measuring unit which measures a moving distance of the carriage 30. The linear encoder 31 is disposed along a main scanning axis and measures the moving distance of the carriage 30 driven along the main scanning axis by the carriage driving mechanism 40. The linear encoder 31 is connected to the controller 50 and sends a result of the measurement to the controller 50.

The carriage driving mechanism 40 moves the carriage 30 in a direction (main scanning direction MA) which crosses a transfer direction (sub-scanning direction SA) of the recording medium 200 between the transfer rollers 11, 12 at right angles along the surface of the recording medium 200 between the transfer rollers 11, 12. Therefore, the carriage driving mechanism 40 can move the recording head 20 together with the carriage 30. In the following description, an axis along the sub-scanning direction SA is defined as a sub-scanning axis, and an axis along the main scanning direction MA is defined as a main scanning axis. The main scanning direction MA substantially corresponds a width direction of the recording medium 200 between the transfer rollers 11, 12. And, sub-scanning direction SA corresponds the transfer direction of the recording medium 200 between the transfer rollers 11, 12.

The recording medium transfer mechanism 10 and carriage driving mechanism 40 cooperate with each other to function as a scanning unit, so that they move the carriage 30 in relation to the recording medium 200 in a predetermined direction along the surface of the recording medium 200 between the transfer rollers 11, 12.

The controller 50 is connected to the recording head 20, the recording medium transfer mechanism 10, and the carriage driving mechanism 40, and controls operations of the recording head 20 and the scanning unit. The controller 50 revises an image recording duty of the recording head 20 (the number of ink injection times per an unit time or unit area) as described later in detail.

Figure 3:
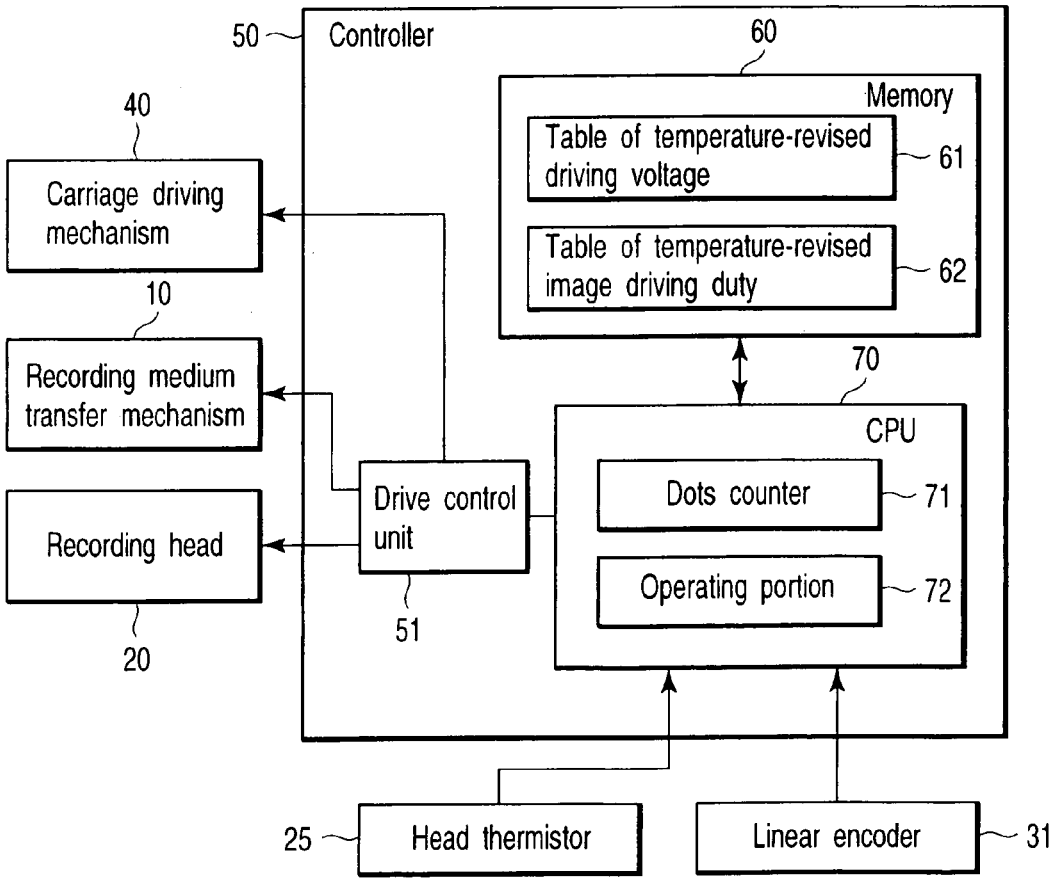
FIG. 3 is a block diagram schematically showing a constitution of a controller in FIG. 1.

Next, the controller 50 will be described in more detail with reference to FIG. 3. The controller 50 includes a memory 60, a CPU 70, and a driving control unit 51.

First, the CPU 70 will be described. The CPU 70 is a control unit which controls the controller 50. The CPU 70 is connected to the memory 60, and constituted in such a manner that data can be read from and written in the memory 60. The CPU 70 is further connected to the driving control unit 51 and sends commands for driving the recording head 20 and the scanning unit (the recording medium transfer mechanism 10 and the carriage driving mechanism 40) to the driving control unit 51.

The CPU 70 further includes a dots counter 71 and an operating portion 72.

The dots counter 71 is an ink drop counting unit which obtains a driving command to be issued to the recording head 20 and counts the number of ink drops ejected by the recording head 20 on a basis of the driving command.

The operating portion 72 is an operating unit which performs a calculation described later for revising the image recording duty in the recording head 20.

The driving control unit 51 is connected to the recording medium transfer mechanism 10, the recording head 20, and the carriage driving mechanism 40, and controls operations thereof in accordance with commands from the CPU 70. The driving control unit 51 especially applies ink ejection energy necessary for ejecting ink to the recording head 20. In the present embodiment, the driving control unit 51 applies a driving voltage as the ink ejection energy to the recording head 20.

The memory 60 is a data storage unit in which data is stored, and includes a table 61 of temperature-revised driving voltage and a table 62 of temperature-revised image recording duty, both tables being described later. Further, the memory 60 storages basic information such as the number of the ink ejection ports (the number of the nozzles) of the recording head 20.

[Operation]

Next, an operation of the image recording apparatus 1 constituted as described above will be described. In general, in an image recording, an optical density of an image recorded on a recording medium increases in proportion to a size of the ejected ink drop and the image recording duty. In order to record an image on the recording medium at a uniform optical density in a predetermined image recording duty, the image recording apparatus 1 of the present embodiment performs a revise (of output) to suppress the size of the ejected ink drop when the temperature of the recording head 20 rises. That is, the image recording apparatus 1 records the image on the recording medium 200 while revising the output. The image recording operation will be described hereinafter in more detail with reference to FIGS. 4 to 7. The image recording operation is performed in a flow shown in FIG. 7.

[Image Recording Start Driving Voltage Setting Step S1]

The image recording apparatus 1 is initially set so that the image recording on the recording medium 200 can be started with a desired optical density. The size of the ink drop which influences the optical density changes in accordance with a temperature TE and driving voltage of the recording head 20. Therefore, in the driving voltage setting step S1, the driving voltage (the start driving voltage) of the recording head 20 at the start of image recording is set on a basis of the temperature of the recording head 20 (measured before the start of image recording).

For the above-described setting, the CPU 70 obtains firstly the temperature TE of the recording head 20 before the start of image recording from the head thermistor 25.

The CPU 70 determines the start driving voltage on the basis of the temperature TE. The inventor of the present invention has derived a relationship between the driving voltage applied to the recording head 20 and the temperature of the recording head 20, under which an image is recorded on the recording medium in a predetermined optical density, from experimental data obtained through experiment executed by the inventor. The relationship is shown in the graph in FIG. 4.

Figures 4, 5:
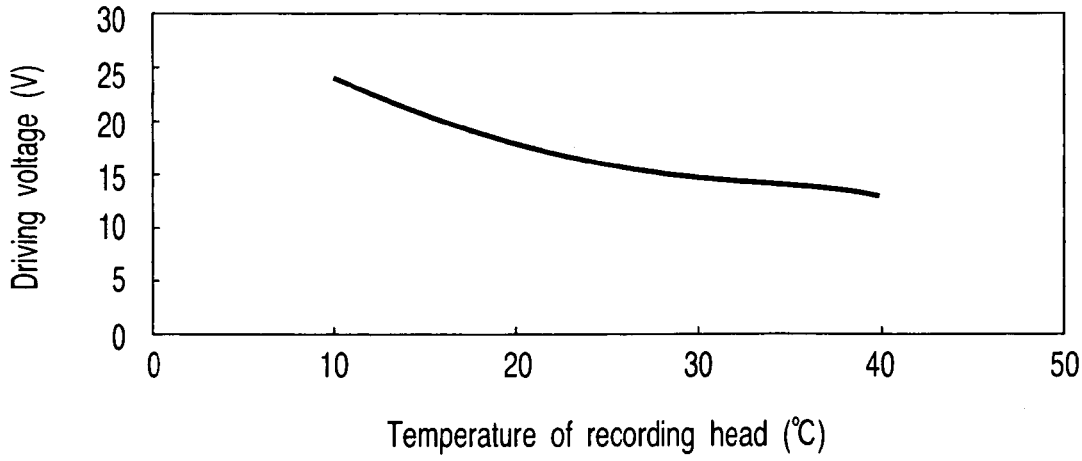
FIG. 4 is a graph showing a relation between a driving voltage and a temperature of the recording head, by which recording is performed with a normal image recording duty.
FIG. 5 is a diagram showing a table of temperature-revised driving voltage.
Figure 7:
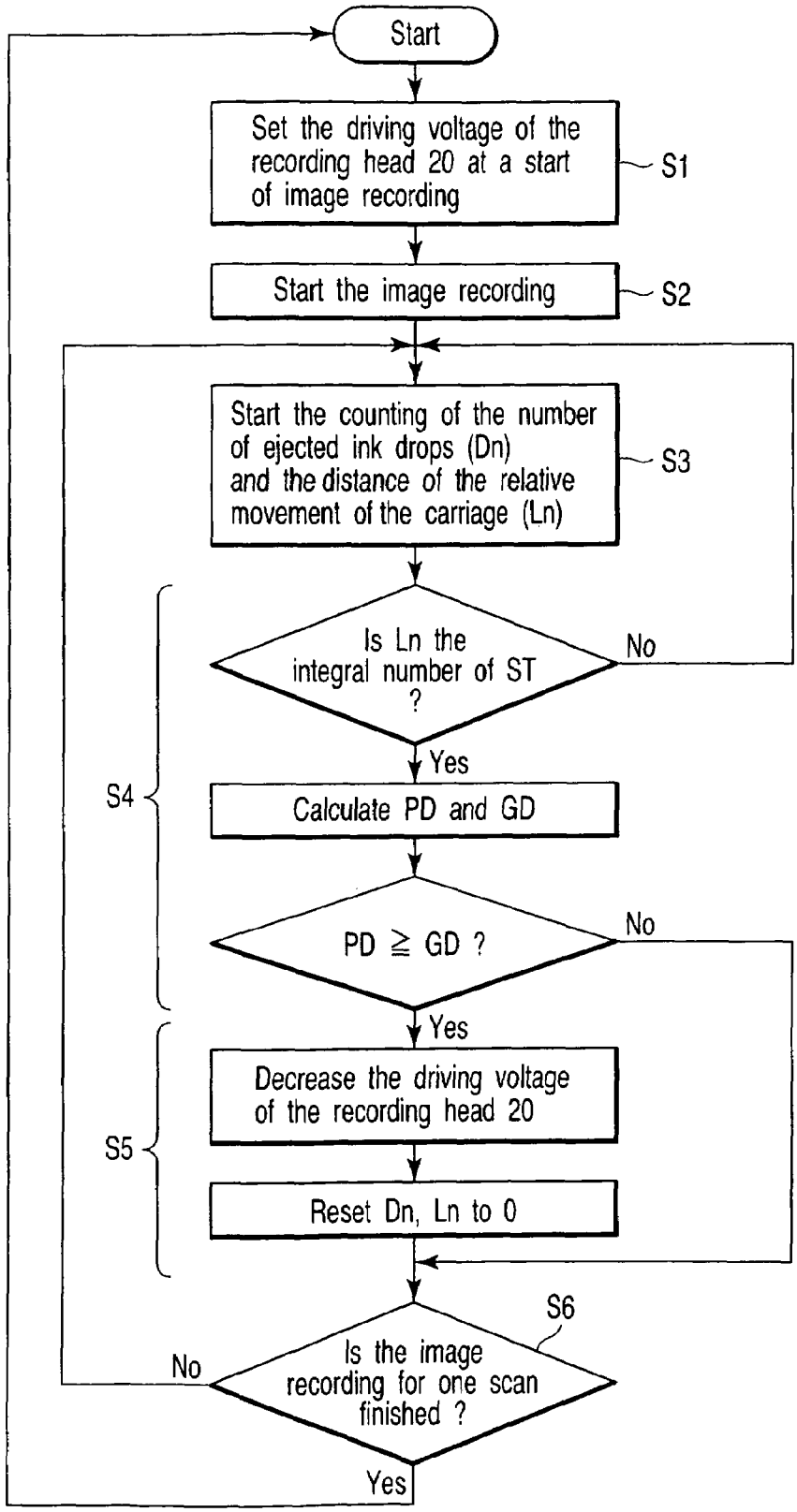
FIG. 7 is a flowchart showing an operation of the image recording apparatus in FIG. 1.

The graph in FIG. 4 is represented on a basis of the table 61 of temperature-revised driving voltage shown in FIG. 5. The table 61 of temperature-revised driving voltage shows preferable driving voltages at temperatures of the recording head 20, which obtains through an eqation derived on the basis of the experimental data. The table 61 of temperature-revised driving voltage is stored in the memory 60. Therefore, the CPU 70 selects the driving voltage at the temperature of the recording head 20 measured by the head thermistor 25 before start of image recording from the table 61 of temperature-revised driving voltage, and sets as an image recording start driving voltage.

After completing the setting of the image recording start driving voltage in this manner, an image recording start step S2 is performed.

[Image Recording Start Step S2]

In the image recording start step S2, the image recording apparatus 1 starts an image recording by a command from the controller 50. Concretely, a driving command from the CPU 70 is sent to the scanning units (the carriage driving mechanism 40 and recording medium transfer mechanism 10) and the recording head 20 through the driving control unit 51. After receiving this command, the carriage driving mechanism 40 makes the carriage 30 start its relative movement in relation to the recording medium 200. Moreover, the image recording start driving voltage is applied to the recording head 20 and starts an ink ejection. Next, a counting step S3 starts.

[Counting Start Step S3]

In the counting start step S3, the dots counter 71 in the CPU 70 starts counting the number Dn of ink drops ejected from the recording head 20. At the same time, the linear encoder 31 starts measuring a relative moving distance Ln of the carriage 30 in relation to the recording medium 200. In the present embodiment, the image recording apparatus 1 is of a serial type. Therefore, the carriage 30 is moved along the main scanning axis. Moreover, every time one scanning operation ends, the recording medium transfer mechanism 10 transfers the recording medium 200 by a predetermined distance along the sub-scanning axis. Therefore, in one scanning operation, the carriage 30 moves for a predetermined distance in one direction along the main scanning axis. As a result, the relative moving distance (integral image recording length) Ln is a moving distance of the carriage 30 along the main scanning axis from an image recording start position.

After starting the count of the number Dn of ink drops and the measurement of the relative moving distance Ln, an image recording duty judgment step S4 is performed.

[Image Recording Duty Judgment Step S4]

In the image recording duty judgment step S4, during the image recording, the image recording duty is compared with a reference image recording duty GD, and it is judged whether or not the image recording duty during the image recording (image recording duty PD) shifts from the reference image recording duty GD. The reference image recording duty GD is an image recording duty by which the image can be recorded with a predetermined optical density at the measured temperature TE of the recording head 20. Therefore, when the image is recorded on the recording medium 200 with a value of the image recording duty PD larger than a value of the reference image recording duty GD at the measured temperature TE of the recording head 20, the optical density of the image recorded on the recording medium 200 becomes higher than a desired optical density. The reference image recording duty GD is calculated by an equation described later.

The comparison is performed every time the carriage 30 moves for a predetermined distance ST. In other words, the comparison is performed, when the relative moving distance Ln of the recording head 20 in relation to the recording medium 200 in one scanning operation is integer times the predetermined distance ST set beforehand. Therefore, the CPU 70 judges whether or not the relative moving distance Ln is integer times the predetermined distance ST. In the present embodiment, the predetermined distance ST is set to about 1.27 cm (about 0.5 inch).

When the relative moving distance Ln is not integer times the predetermined distance ST in the judgment, the count of the number of ejected ink drops and the measurement of the relative moving distance Ln of the carriage 30 started in the counting start step S3 are performed continuously.

When the relative moving distance Ln is integer times the predetermined distance ST in the judgment, the image recording duty PD and the reference image recording duty GD at this time are calculated.

The image recording duty PD is obtained by the operating portion 72. Concretely, at first the operating portion 72 obtains the number Nn of the nozzles of the recording head 20, the relative moving distance Ln, and the number Dn of ink drops (integral dot number) . The operating portion 72 calculates the image recording duty PD through the following equation 1 by the use of these three values.

$$PD=Dn/(Ln\times Nn) \quad \text{(Equation 1)}$$

Subsequently, the reference image recording duty GD is obtained. The inventor of the present invention has derived a conclusion that the reference image recording duty GD is obtained by the following equation 2 on the basis of the experimental data.

$$GD=(\alpha\times PD2-\beta\times PD+\gamma\times\Delta T)/(Ln\times Nn) \quad \text{(Equation 2)},$$

where $\alpha$: coefficient 1, $\beta$: coefficient 2, $\gamma$: coefficient 3, and $\Delta T$: temperature revision coefficient.

Since the reference image recording duty GD depends on characteristics of the recording head 20 and ink, $\alpha$, $\beta$, and $\gamma$ of the coefficients 1 to 3 are revision coefficients depending on these characteristics. In a certain recording head and ink, (Example 1), $\alpha=1$, $\gamma=33$, and $\beta=4000$ are set.

To obtain the reference image recording duty GD with good precision, a temperature function needs to be considered. Since the size of the ink drop during the image recording changes on the basis of the size of the ink drop at the temperature of the recording head 20 measured at the start of the image recording, with proceeding of the image recording, the temperature revision coefficient $\Delta T$ is a coefficient for revising the change in the size of the ink drop during the image recording. The inventor of the present invention has derived a conclusion that the temperature revision coefficient $\Delta T$ at a certain temperature of a certain recording head (the temperature TE of the head thermistor) is obtained through the following equation 3 based on the experimental data.

$$\Delta T=\epsilon\times TE+\eta \quad \text{(Equation 3)},$$

where $\epsilon$: coefficient 4, and $\eta$: coefficient 5. The $\epsilon$ and $\eta$ of the coefficients 4 and 5 are selected from the table 62 of temperature-revised image recording duty in FIG. 6 derived by the inventor of the present invention on a basis of the experimental data, in accordance with the image recording duty PD and the temperature TE. In FIG. 6, $\epsilon$ is shown as "slope", and $\eta$ is shown as "intercept". For example, while the recording head and ink of Example 1 are used, when the image recording duty PD is 5 or more and less than 10, and the temperature TE is 26 centigrade, $\epsilon=-0.1$, $\eta=3.7$ are set.

After the image recording duty PD and the reference image recording duty GD are obtained through these equations 1 to 3, they are then compared with each other by the operating portion 72.

In the comparison, when the image recording duty PD is not less than the reference image recording duty GD, an ink ejection energy revision step S5 starts.

In the comparison, when the image recording duty PD is smaller than the reference image recording duty GD, the value of the relative moving distance Ln and the number Dn of ink drops both of which have been measured and counted for calculating the image recording duty PD and reference image recording duty GD are maintained, and then an end check step S6 is performed.

[Ink Ejection Energy Revision Step S5]

When the image recording duty PD is larger than the reference image recording duty GD, the density of the image recorded on the recording medium 200 is higher than a desired density. In this case, in the discharge energy correction step S5, to match the density of the image recorded on the recording medium 200 with the desired density, the CPU 70 orders the driving control unit 51 to lower the driving voltage which is ink ejection energy applied to the recording head 20 by a predetermined value. In the present embodiment, the driving voltage is lowered by 0.08 V.

Moreover, the relative moving distance Ln and the number Dn of ink drops both of which have been measured and counted for the calculation of the image recording duty PD and the reference image recording duty GD are reset to 0. After the resetting, the end check step S6 is subsequently performed.

[End Check Step S6]

In the end check step S6, the operating portion 72 checks whether or not one scanning operation has been finished on a basis of the relative moving distance Ln which has been measured for controlling the scanning of the carriage 30 separately from the relative moving distance Ln measured for the calculation of two image recording duties PD and GD. When one scanning operation has not finished yet, the counting start step S3 is performed again. In this case, the driving voltage revised in the ink ejection energy correction step S5 is maintained until the driving voltage is next revised in the ink ejection energy revision step S5.

Moreover, when one scanning operation is finished, the number Dn of ink drops and the relative moving distance Ln, both of which have been counted and measured for the calculation of two image recording duties PD and GD, and the current temperature TE are reset to zero, and the next scanning operation starts.

In this manner, the image recording apparatus 1 of the present embodiment records the image on the recording medium 200.

As described above, the CPU 70 which is the control unit of the present embodiment calculates the image recording duty PD on the basis of the number Nn of nozzles of the recording head 20, the relative moving distance Ln, and the number Dn of ink drops (integral dot number), and further calculates the reference image recording duty GD on the basis of the temperature TE of the recording head 20 and the image recording duty PD. Then, the CPU controls the ink ejection energy (driving voltage) applied to the recording head 20 in accordance with a result of comparison of the image recording duty PD with the reference image recording duty GD. Therefore, in the image recording apparatus 1 of the present embodiment, when the temperature of the recording head 20 changes during the image recording, the ink ejection energy (driving voltage) applied to the recording head 20 is controlled so that the optical density of the image recorded on the recording medium 200 is prevented from becoming higher than the desired optical density and generation of optical density unevenness can be reduced or prevented. The image recording duty PD can be calculated in a short time as compared with analysis of recorded image data. Therefore, in the image recording apparatus 1 of the present embodiment, the generation of the optical density unevenness can be decreased or prevented without decreasing a throughput which is a time necessary for recording a desired image on the recording medium 200.

Figure 8:
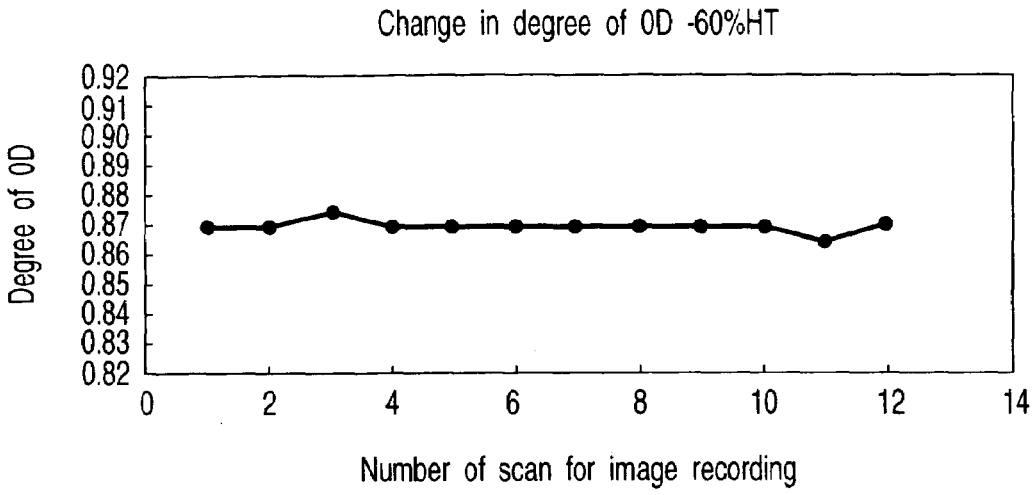
FIG. 8 is a graph showing a change in an optical density of a part of an image recorded on a recording medium by each scanning operation while the recording head is scanned a plurality of times to record the image on the recording medium in the image recording apparatus of FIG. 1.
Figure 9:
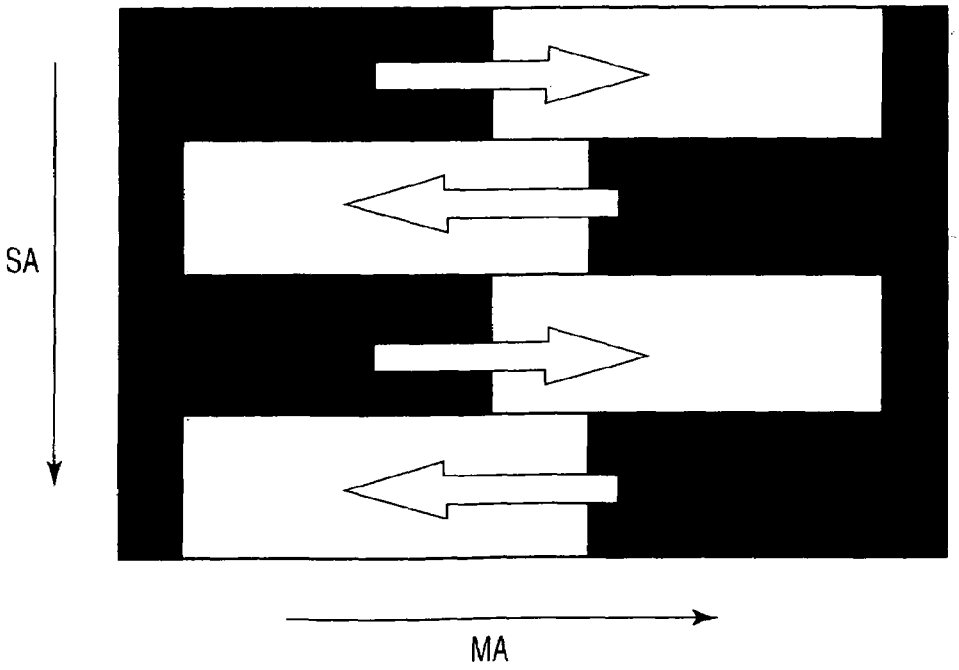
FIG. 9 shows an image recorded on the recording medium by an image recording apparatus according to a modification of the embodiment of the present invention.

When the ink ejection energy is revised as described above, the change in the optical density of the image recorded on the recording medium at a half tone of 60% of an image recording pattern is kept at a substantially constant optical density even if the image is recorded by a plurality of scanning operations as shown in FIG. 8. Therefore, in the image recording apparatus 1 of the present embodiment, the image can be recorded on the recording medium with a high image quality without generating the density unevenness.

Moreover, the CPU 70 compares the image recording duty PD with the reference image recording duty GD, and can control the ink ejection energy applied to the recording head 20 in accordance with the result of the comparison. Therefore, the image recording apparatus 1 of the present embodiment decreases the shift of the image recording duty PD from the reference image recording duty GD. Therefore, the image recording apparatus 1 of the present embodiment can prevent the generation of the density unevenness more firmly.

Furthermore, in the image recording apparatus 1 of the present embodiment, when the image recording duty PD is not less than the reference image recording duty GD, the ink ejection energy applied to the recording head 20 is reduced. When the energy applied to the recording head 20 is decreased, the image recording duty PD lowers. Therefore, in the image recording apparatus 1 of the present embodiment, even when the optical density of the image during the image recording becomes higher than that of the image at the start of the image recording by a temperature rise of the recording head 20 or the like, the rise of the optical density of the recorded image is revised and the density unevenness in the recorded image is prevented.

Additionally, in the image recording apparatus 1 of the present embodiment, when the operating portion 72 judges that a value of the image recording duty PD is smaller than a value of the reference image recording duty GD, the ink ejection energy applied to the recording head 20 is maintained in a state before the comparison. Accordingly, in the image recording apparatus 1 of the present embodiment, when the value of the image recording duty PD is smaller than the value of the reference image recording duty GD, the ink ejection energy applied to the recording head 20 is maintained, and the density unevenness is prevented from being generated in the recorded image.

Moreover, the operating portion 72 can compare the image recording duty PD with the reference image recording duty GD every time the carriage 30 relatively moves by a predetermined moving distance in relation to the recording medium 200 during the image recording. Therefore, the image recording apparatus 1 of the present embodiment can revise the image recording duty PD with higher precision by performing the above-described comparison a plurality of times.

Furthermore, when the operating portion 72 judges that the value of the image recording duty PD is larger than the value of the reference image recording duty GD, the CPU 70 resets a value of the relative moving distance Ln and a value of the number Dn of ink drops, which have been measured and counted for the calculation of two image recording duties PD and GD, to zero. Then, the measurement of the relative moving distance Ln and the counting of the number Dn of ink drops are started again for the calculation of two image recording duties PD and GD. Therefore, even when two image recording duties PD and GD are compared with each other a plurality of times, each comparison can be performed correctly without being influenced by the former data used for the former revision.

Additionally, the image recording apparatus 1 of the present embodiment includes the head thermistor 25 which is a temperature detection unit to detect the temperature of the recording head 20, and calculates the reference image recording duty GD on a basis of the temperature TE of the recording head 20 detected by this thermistor.

Therefore, when two duties are compared with each other a plurality of times, it is possible to correctly obtain the reference image recording duty GD on the basis of the temperature of the recording head 20 each time.

Figures 10, 11:
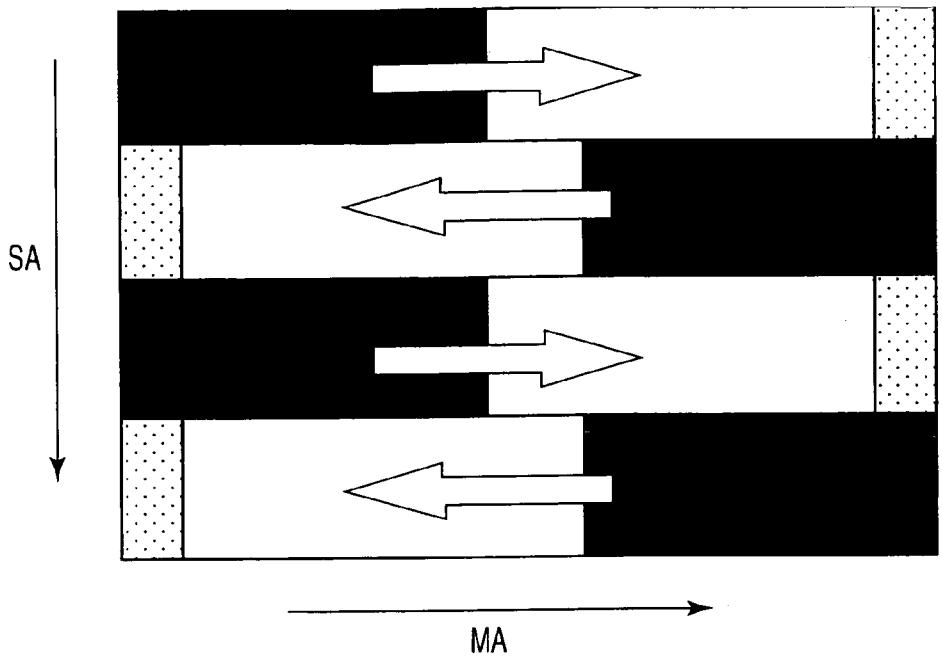
FIG. 10 shows an image recorded on the recording medium by an image recording apparatus according to another modification of the embodiment of the present invention.
FIG. 11 is a diagram showing a change in the driving voltage applied to the recording head of the image recording apparatus according to the modification of the embodiment of the present invention while the image shown in FIG. 9 is recorded on the recording medium.
Figure 12:
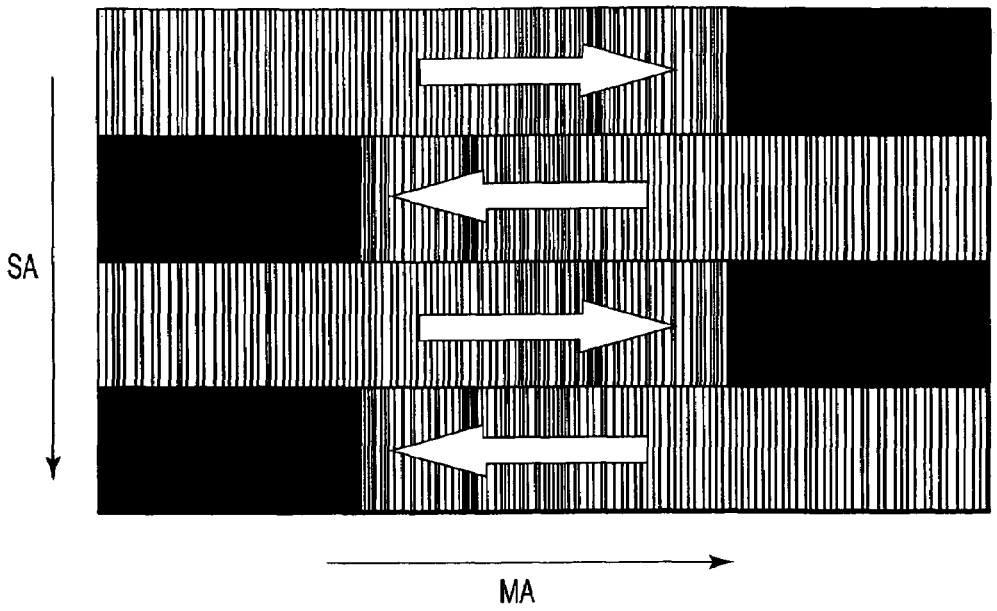
FIG. 12 PRIOR ART
FIG. 12 shows an image recorded on a recording medium by a plurality of scanning operations of a recording head in a conventional image recording apparatus.
Figure 13:
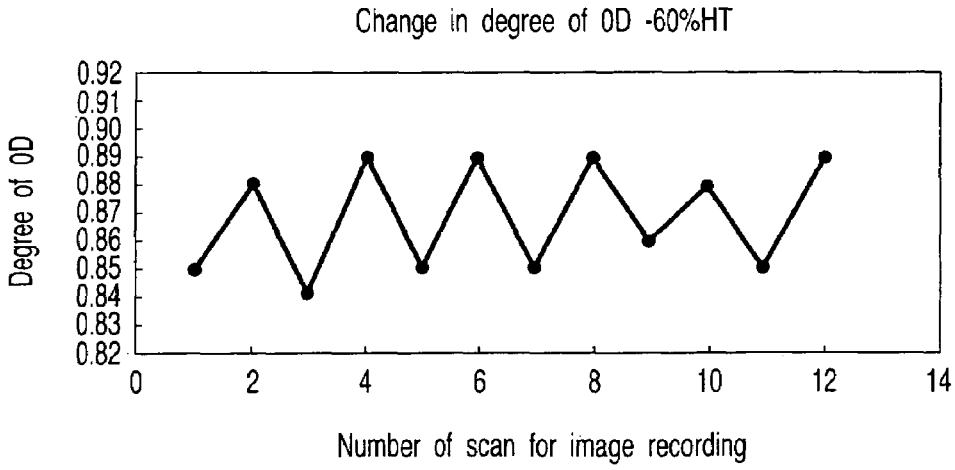
FIG. 13 PRIOR ART
FIG. 13 is a graph showing a change in an optical density of a part of an image recorded on the recording medium by each scanning operation while the image is recorded on the recording medium as shown in FIG. 12 by the conventional image recording apparatus.

In the above description about the operation of the image recording apparatus 1, only the controlling for decreasing the ink ejection energy applied to the recording head 20 has been described in a case where the viscosity of the ink in the recording head 20 lowers by the temperature rise of the recording head 20 with the ink discharge operation. However, in the image recording apparatus 1 of the present embodiment, the ink ejection energy applied to the recording head 20 may also be increased in a case where the temperature of the recording head 20 lowers and the viscosity of the ink in the recording head 20 increases during the image recording. For example, the image data shown in FIG. 9 includes a large blank portion in which printing is not performed in each scanning. In a case where the image recording apparatus 1 records an image on the recording medium 200 on the basis of the image data, the temperature of the recording head 20 lowers in the blank data portion while the image recording is not performed. In this case, in a comparison of the reference image recording duty GD with the image recording duty PD, the image recording duty PD is smaller than the reference image recording duty GD in a predetermined range. In this case, the CPU 70 of the image recording apparatus 1 controls the driving control unit 51 to increase the ink ejection energy applied to the recording head 20. The controlling may also be performed by a combination of increase and decrease of the ink ejection energy applied to the recording head 20, for example, as shown in FIG. 11. When the controlling is performed in this manner, the image recording apparatus 1 can record the image on the recording medium 200 with high image quality in a case where the temperature of the recording head 20 lowers during the image recording.

Moreover, in the image recording apparatus 1 of the present embodiment, the dots counter 71 integrates all the numbers of ejected ink dots, but the number of ink dots during the recording in a region having a low resolution without being influenced by the temperature rise of the recording head 20 as shown in gray in FIG. 10 may not be integrated.

In the present embodiment, the relative moving distance Ln has been measured by the linear encoder, but another known relative moving distance measuring apparatus may also be used, and the relative moving distance Ln may also be calculated on the basis of a moving speed and time of the carriage 30.

Moreover, in the present embodiment, the driving voltage applied to the recording head 20 is adjusted every 0.08 V. However, since an adjustment amount of the driving voltage for adjusting the ink ejection energy of the ink changes in accordance with the recording head and ink for use, the adjustment amount is not limited to the above-described value, and may be optionally changed.

Furthermore, in the present embodiment, the ink ejection energy is adjusted by adjusting the driving voltage applied to the recording head 20. But, needless to say, the ink ejection energy may be adjusted by adjusting other numerical values such as a pulse width, frequency and the like of a current applied to the recording head 20 in accordance with characteristics of the recording head.

Additionally, the image recording apparatus 1 of the present embodiment is of a serial type in which the carriage itself scans, but may also be of a full line type. In this case, the relative moving distance Ln is a transfer amount of the recording medium 200 with respect to the carriage.

Additional advantages and modifications will readily occur to those skilled in the art. Therefore, the invention in its broader aspects is not limited to the specific details and representative embodiments shown and described herein. Accordingly, various modifications may be made without departing from the sprit or scope of the general inventive concept as defined by the appended claims and their equivalents.

What is claimed is:

1. An image recording apparatus comprising:

a carriage;

a scanning unit which moves the carriage in relation to a recording medium;

a recording head which is mounted on the carriage and which ejects ink in accordance with energy for ink ejection applied thereto, the recording head ejecting ink while the carriage moves in relation to the recording medium so as to record an image on the recording medium;

a moving distance measuring unit which measures a relative moving distance of the carriage in relation to the recording medium;

a temperature detection unit which detects a temperature of the recording head; and a control unit;

wherein the control unit comprises:

an ink drop counting unit which counts a number of ink drops ejected from the recording head; and an operating portion, which calculates: (i) when the carriage moves a predetermined distance in relation to the recording medium, an image recording duty based on the relative moving distance of the carriage measured by the moving distance measuring unit and the number of ink drops ejected from the recording head counted by the ink drop counting unit while the carriage moves the measured relative moving distance, and (ii) a reference image recording duty, corresponding to the calculated image recording duty, based on a detection result of the temperature detection unit;

wherein the operating portion compares a value of the reference image recording duty with a value of the calculated image recording duty; and wherein the control unit controls the ink ejection energy applied to the recording head in accordance with a result of the comparison by the operating portion.

2. An image recording apparatus according to claim 1, wherein the control unit sets the ink ejection energy applied to the recording head to be smaller than the ink ejection energy applied before the comparison, when the operating portion judges that the value of the calculated image recording duty is not less than the value of the corresponding reference image recording duty.

3. An image recording apparatus according to claim 2, wherein the operating portion performs the comparison every time that the carriage moves the predetermined distance in relation to the recording medium during the image recording.

4. An image recording apparatus according to claim 3, wherein the control unit resets the counted number of ink drops, when the operating portion judges that the value of the calculated image recording duty is larger than the value of the corresponding reference image recording duty.

5. An image recording apparatus according to claim 3, wherein the control unit resets the measured relative moving distance, when the operating portion judges that the value of the calculated image recording duty is larger than the value of the corresponding reference image recording duty.

6. An image recording apparatus according to claim 1, wherein the control unit maintains the ink ejection energy to be the same as the ink ejection energy applied to the recording head before the comparison, when the operating portion judges that the value of the calculated image recording duty is smaller than the value of the corresponding reference image recording duty.

7. An image recording apparatus according to claim 6, wherein the operating portion performs the comparison every time that the carriage moves the predetermined distance in relation to the recording medium during the image recording.

8. An image recording apparatus according to claim 7, wherein the control unit resets the counted number of ink drops, when the operating portion judges that the value of the calculated image recording duty is larger than the value of the corresponding reference image recording duty.

9. An image recording apparatus according to claim 7, wherein the control unit resets the measured relative moving distance, when the operating portion judges that the value of the calculated image recording duty is larger than the value of the corresponding reference image recording duty.

10. An image recording apparatus according to claim 1, wherein the operating portion performs the comparison every time that the carriage moves the predetermined distance in relation to the recording medium during the image recording.

11. An image recording apparatus according to claim 10, wherein the control unit resets the counted number of ink drops, when the operating portion judges that the value of the calculated image recording duty is larger than the value of the corresponding reference image recording duty.

12. An image recording apparatus according to claim 10, wherein the control unit resets the measured relative moving distance, when the operating portion judges that the value of the calculated image recording duty is larger than the value of the corresponding reference image recording duty.

13. An image recording method, in which an image is recorded on a recording medium by relatively moving a carriage holding a recording head in relation to the recording medium and by applying ink ejection energy to the recording head during the relative movement of the carriage so that ink is ejected from the recording head to record the image on the recording medium, the method comprising:

measuring a relative moving distance of the carriage in relation to the recording medium;

counting a number of ink drops ejected from the recording head;

calculating an image recording duty based on the measured relative moving distance of the carriage and the number of ink drops counted as being ejected from the recording head while the carriage moves the measured relative moving distance, when the carriage moves a predetermined distance in relation to the recording medium;

calculating a reference image recording duty, corresponding to the calculated image recording duty, based on a temperature of the recording head; and controlling the ink ejection energy applied to the recording head based on a comparison of the calculated image recording duty with the corresponding reference image recording duty.

* * * * *